US006592057B1

(12) United States Patent
Ericksen et al.

(10) Patent No.: US 6,592,057 B1
(45) Date of Patent: Jul. 15, 2003

(54) MULTI-DIRECTIONAL SPRAY NOZZLE

(75) Inventors: Kent C. Ericksen, North Salt Lake, UT (US); Robert Parker, West Valley City, UT (US)

(73) Assignee: Orbit Irrigtion Products, Inc., Bountiful, UT (US)

( * ) Notice: Subject to any disclaimer, the term of this patent is extended or adjusted under 35 U.S.C. 154(b) by 0 days.

(21) Appl. No.: 10/154,548

(22) Filed: May 24, 2002

Related U.S. Application Data

(60) Provisional application No. 60/293,734, filed on May 25, 2001.

(51) Int. Cl.[7] ..... B05B 15/08

(52) U.S. Cl. ..... 239/587.1; 239/587.2; 239/587.3; 239/587.4; 239/587.5; 239/587.6; 239/525; 239/526

(58) Field of Search ..... 239/587.1, 587.2, 239/587.3, 587.4, 587.5, 587.6, 525, 526, 530, 538, 539, 451, 456, 457, 541

(56) References Cited

U.S. PATENT DOCUMENTS

| | | | | | |
|---|---|---|---|---|---|
| 1,087,006 | A | * | 2/1914 | Fitzsimons | 239/507 |
| 1,832,724 | A | * | 11/1931 | Mueller | 239/539 |
| 3,001,725 | A | | 9/1961 | Lockett | |
| 4,840,313 | A | | 6/1989 | Hansen | 239/456 |
| 4,878,621 | A | * | 11/1989 | Krueger | 239/458 |
| 5,507,534 | A | * | 4/1996 | Reifenberger et al. | 285/122.1 |
| 5,615,837 | A | | 4/1997 | Roman | 239/530 |
| D382,937 | S | | 8/1997 | Shfaram | D23/223 |
| 5,845,851 | A | | 12/1998 | Shfaram | 239/525 |
| D408,068 | S | | 4/1999 | Hui-Chen | D23/223 |
| D408,889 | S | | 4/1999 | Hui-Chen | D23/223 |
| D409,717 | S | | 5/1999 | Heren et al. | D23/213 |
| 6,036,117 | A | | 3/2000 | Heren et al. | 239/456 |
| 6,216,965 | B1 | * | 4/2001 | Chao | 239/587.4 |
| 6,264,121 | B1 | * | 7/2001 | McClary | 239/525 |
| 6,409,103 | B1 | * | 6/2002 | Norville et al. | 239/587.1 |

FOREIGN PATENT DOCUMENTS

| | | |
|---|---|---|
| IL | 25389 | 12/1996 |

OTHER PUBLICATIONS

Water Wand Image.
2000 Season—Sunmate Product Catalog p. 26.
Waternet Catalog—the Nozzle Family.
1998 Season—Sunmate Hose End Products.

* cited by examiner

*Primary Examiner*—Robin O. Evans
(74) *Attorney, Agent, or Firm*—Madson & Metcalf

(57) ABSTRACT

A multi-directional spray nozzle is disclosed. The multi-directional spray nozzle may include a grip member and a pivotal member. A rounded end of the pivotal member pivotally engages a socket of the grip member in either a ball-and-socket configuration or a hinged joint configuration. An internal passage of the grip member is in fluid communication with a pivotal passage situated within the rounded end of the pivotal member. The pivotal passage is in fluid communication with an exit port on the pivotal member. A pressurized fluid may be emitted from an exit port on the pivotal member. The pivotal member may be positioned at various angles with respect to the grip member to direct the emitted fluid to a desired location.

27 Claims, 5 Drawing Sheets

MULTI-DIRECTIONAL SPRAY NOZZLE

RELATED APPLICATIONS

The present application is related to and claims priority from U.S. Provisional Application No. 60/293,734, entitled "Multi-Directional Spray Nozzle," filed May 25, 2001, with inventors Kent C. Ericksen and Robert Parker, which is hereby incorporated by reference in its entirety.

BACKGROUND OF THE INVENTION

1. Field of the Invention

The present invention relates to an apparatus and method for comfortably directing a pressurized fluid to a desired location. More specifically, the present invention relates to a multi-directional spray nozzle.

2. Technical Background

Spray nozzles are used in a wide variety of circumstances in today's society. For instance, both commercial and amateur gardeners may use spray nozzles to deliver water, pesticides, or other chemicals to a desired location. Spray nozzles are also used in commercial settings for cleaning purposes. These nozzles may be used, for example, to clean an automobile garage or a manufacturing plant. The spray nozzles used to deliver these fluids are critical to maintaining a clean, healthy, and safe work environment.

Conventional spray nozzles come in a number of different configurations. For instance, spray nozzles may be made in banana-shaped, pistol-shaped, or linear configurations. In each of these configurations, the direction of the emitted spray is fixed relative to the grip portion of the nozzle. As a consequence, the user may be required to contort his arm or wrist in order to direct the spray to a particular location, such as a location near a user's feet or an elevated location. Holding the arm and wrist in such a contorted position is uncomfortable and extremely tiresome, particularly if the position must be maintained for a period of time. This fatigue and inconvenience are magnified to elderly or arthritic users, who may comprise a large percentage of hobby gardeners. Also, the fatigue may be exacerbated when fluids are emitted from a spray nozzle with significant force. Frequent users may develop serious health problems such as carpal tunnel syndrome.

Accordingly, it would be an advancement in the art to provide a spray nozzle that may be comfortably held by a user while the spray is directed to a desired location. It would be a further advancement in the art to provide a spray nozzle that enables each user to select from a wide range of spray directions without uncomfortable repositioning of the arm or wrist. Furthermore, another advancement would enable the user to quickly and conveniently change the direction of an emitted spray relative to the grip portion of a spray nozzle.

SUMMARY OF THE INVENTION

The apparatus and method of the present invention have been developed in response to the present state of the art, and in particular, in response to problems and needs in the art that have not yet been fully solved by currently available spray nozzles. More specifically, the multi-directional spray nozzle enables a user to direct an emitted spray pattern in a desired direction while maintaining a grip member in a comfortable position.

The multi-directional spray nozzle may include an insulated grip member that is shaped to be grasped by a human hand and a pivoting member. The pivoting member pivotally engages the grip member. When the spray nozzle is connected to a hose, a pressurized fluid may be emitted from an exit port on the pivoting member. Accordingly, a user may grasp the grip member of the nozzle in a comfortable position. The pivoting member may be adjusted to a particular angle relative to the grip member to direct the spray pattern to a desired location.

The grip member includes a water source coupling for interlocking with a hose for delivery of a pressurized fluid to the nozzle. The coupling may be embodied in various forms. For instance, the coupling may be threaded for connection to a standard water hose or may include a "quick-change" coupling device.

The grip member may also have an internal passage. The internal passage is in fluid communication with the water source coupling. The internal passage generally extends along a length of the grip member and may have a rounded cross-sectional shape.

The internal passage may also include a reservoir. The reservoir permits pressurized fluid to move from the internal passage to a socket of the grip member. The reservoir may be wider than the remainder of the internal passage, but slightly narrower than a diameter of the rounded socket when the reservoir meets the socket. Thus, the internal passage permits transmission of a pressurized fluid from the coupling to the socket.

The socket is in fluid communication with the reservoir of the internal passage. The socket has a generally rounded shape. More specifically, in a first embodiment of the nozzle, the socket has a generally spherical shape. The socket also includes an exterior opening, which has a generally circular shape.

As stated above, the nozzle has a pivoting member. The pivoting member includes a stem having a rounded end and an adjusting sleeve. The stem is elongated and, excluding the rounded end, has a generally cylindrical shape. As will be explained in greater detail below, the stem is at least partially positioned within the adjusting sleeve and is rotatably engaged by the adjusting sleeve.

In the first embodiment, the rounded end of the stem has a generally spherical shape and pivotally engages the socket to form a ball-and-socket joint. The exterior opening of the socket has a circular shape. The stem and a portion of the rounded end extend out of the exterior opening of the socket. Accordingly, a longitudinal axis of the pivoting member may be positioned within a generally conical range of positions relative to the grip member.

A longitudinal passage passes through a portion of the stem and its rounded end. The longitudinal passage is in fluid communication with the internal passage of the grip member. More specifically, an open end of the longitudinal passage is positioned in fluid communication with and adjacent to the reservoir of the internal passage at each angle in which the pivoting member is within the conical range of positions. At each of these angles, the open end of the longitudinal passage maintains fluid communication with the internal passage.

The longitudinal passage is also in fluid communication with an outlet through which a pressurized fluid exits the stem. The stem includes one or more outlets of various sizes, shapes, and positions on the stem. For instance, an array of outlets may be positioned in a circular pattern around the stem.

A grommet is disposed around the stem. The grommet is circular to conform to the exterior surface of the stem. The grommet is made from rubber or a flexible plastic material.

The grommet is positioned around the sleeve to form a seal between the stem and adjusting sleeve. The stem may also include outward threads. The outward threads are shaped to mate with inward threads on the adjusting sleeve.

The stem also has a head positioned on one end of the stem. The head includes a broad tip, a narrow neck, and a broadening portion. The narrow neck is positioned between the broad tip and the broadening portion. The narrow neck is more narrow than both the broad tip and the broadening portion. The broadening portion increases in width in a direction away from the narrow neck. At its widest point, the broadening portion is wider than the broad tip.

As stated above, the nozzle also includes an adjusting sleeve. The adjusting sleeve has an inner cavity. The inner cavity is generally sized to receive the stem. Inward threads are formed within the inner cavity. As stated above, the inward threads mate with the outward threads of the stem. Accordingly, the adjusting sleeve rotates about the stem in threaded engagement.

One end of the adjusting sleeve is partially enclosed to define an exit orifice. The exit orifice is in fluid communication with the inner cavity. The head of the stem is partially disposed within the exit orifice to form an exit port through which pressurized fluid exits the nozzle. The broad tip and narrow neck of the head is more narrow than the exit orifice such that the broad tip can pass through the exit orifice. The broadening portion, at its widest point, is wider than the exit orifice such that at least a part of the broadening portion cannot pass through the exit orifice.

Because the adjusting sleeve and stem are in threaded engagement, rotation of the adjusting sleeve relative to the stem changes a position of the head relative to the exit orifice. Changing the position of the head relative to the exit orifice alters a spray pattern of a pressurized fluid exiting the nozzle. For instance, moving the broadening portion of the head closer to the exit orifice increases a width of the spray pattern. Also, rotation of the adjusting sleeve such that the broadening portion of the head is forced against the exit orifice closes the exit port.

In addition, the grommet of the stem provides a substantially fluid-tight seal between the stem and the adjusting sleeve. Accordingly, a pressurized fluid passes from the hose through the internal passage of the grip member and then through the longitudinal passage of the stem. As the pressurized fluid exits the outlet of the stem, the fluid passes into and fills a portion of the inner cavity bounded by the grommet. The pressurized fluid is then forced out of the inner cavity through the exit port.

In a second embodiment of the multi-directional nozzle, the rounded end of the stem has a cylindrical shape instead of a spherical shape. Also, the socket of the grip member has a generally cylindrical shape instead of a circular shape. The exterior opening of the socket may be elongated instead of circular.

Accordingly, in the second embodiment, the rounded end of the pivoting member pivotally engages the socket of the grip member to form a hinged joint. As such, a longitudinal axis of the pivoting member is positionable within a linear range of positions relative to the grip member.

In view of the foregoing, the multi-directional spray nozzle provides substantial advantages over conventional nozzles. The pivoting member of the multi-directional spray nozzle can be positioned at a number of different angles relative to the grip member. Accordingly, the spray pattern of the multi-directional spray nozzle is positionable in a desired direction while the grip member is held by the user in a comfortable position.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the advantages and features of the invention are obtained, a more particular description of the invention summarized above will be rendered by reference to the appended drawings. Understanding that these drawings illustrate only selected embodiments of the invention and are not therefore to be considered limiting in scope, the invention will be described and explained with additional specificity and detail through the use of the accompanying drawings in which.

DETAILED DESCRIPTION OF THE PREFERRED EMBODIMENTS

The preferred embodiments of the invention are now described with reference to FIGS. 1–5. The members of the present invention, as generally described and illustrated in the Figures, may be implemented in a wide variety of configurations. Thus, the following more detailed description of the embodiments of the system and method of the present invention, as represented in the Figures, is not intended to limit the scope of the invention, as claimed, but is merely representative of presently preferred embodiments of the invention.

Figure 1:
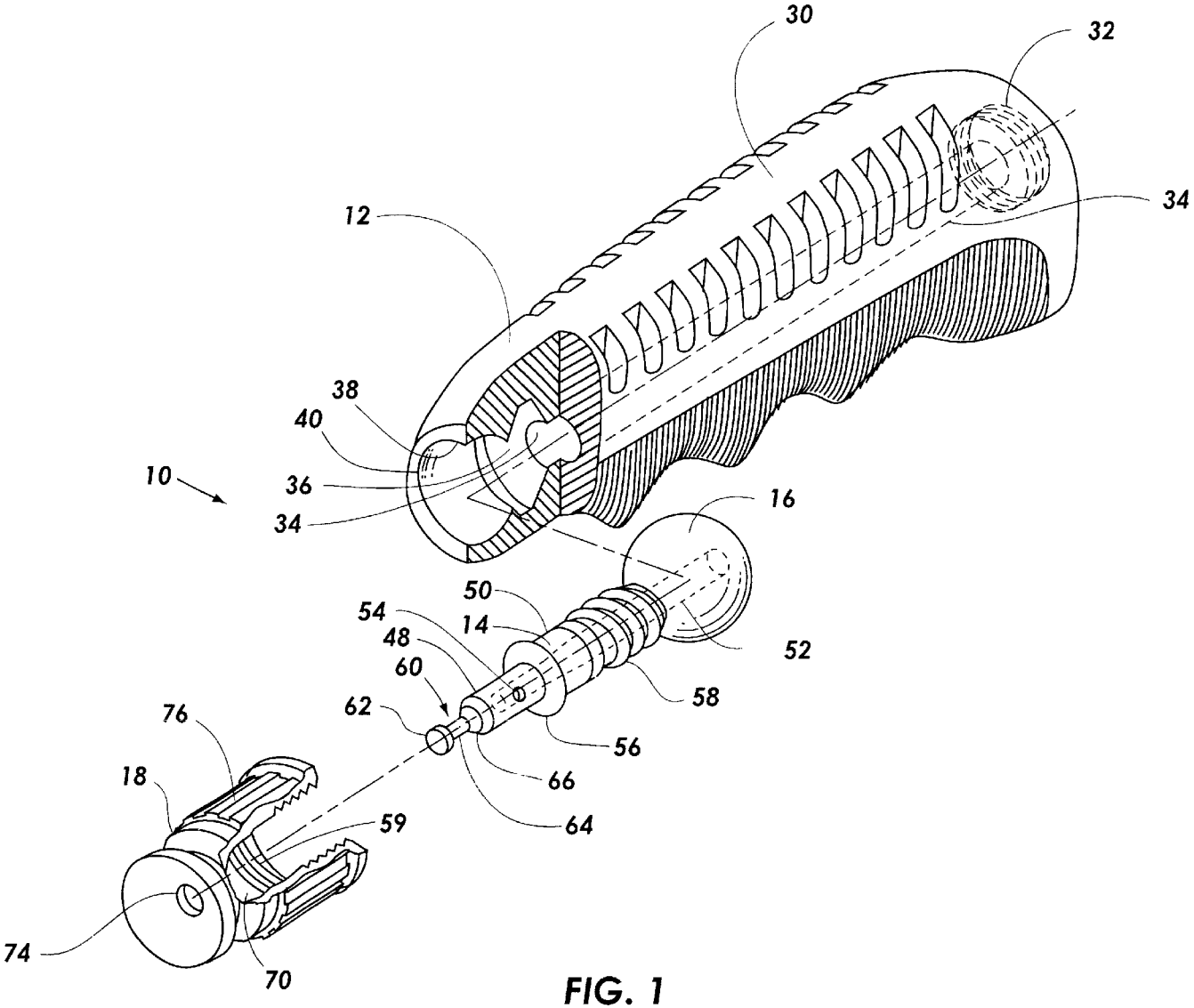
FIG. 1 is an exploded perspective view of a first embodiment of a multi-directional spray nozzle with a partially cutaway view of a grip member and an adjusting sleeve.

Referring to FIG. 1, an exploded perspective view of a first embodiment of a multi-directional spray nozzle 10 is shown. As illustrated in FIG. 1, the multi-directional spray nozzle 10 includes a grip member 12, a stem 14 having a rounded end 16, and an adjusting sleeve 18.

The grip member 12 optionally includes an insulated grip 30. The insulated grip 30 is shaped to receive a human hand, as shown in FIG. 1. The insulated grip 30 may be made from, for example, a soft plastic or rubber to provide a comfortable interface by which a user grasps the nozzle 10.

Furthermore, the insulated grip 30 limits the transfer of the hot or cold temperatures of a fluid passing through the grip member 12 to a user's hand. Accordingly, a user can comfortably hold the nozzle 10 for extended periods of time even when hot or cold fluid pass through the nozzle 10.

The grip member 12 also has a water source coupling 32 for interlocking with a hose (not shown) or other hollow structure for delivery of a pressurized fluid to the nozzle 10. The coupling 32 may be embodied in various forms. For instance, the coupling 32 may be threaded for connection to a standard water hose (as shown in FIG. 1) or may include a "quick-change" coupling device (not shown, but generally known in the industry).

The grip member 12 also has an internal passage 34. The internal passage 34 is in fluid communication with the water source coupling 32. The internal passage 34 generally extends along a length of the grip member 12 and may have a rounded cross-sectional shape.

The internal passage 34 may optionally include a reservoir 36. The reservoir 36 permits pressurized fluid to move from the internal passage 34 to a socket 38 of the grip member 12. The reservoir 36 may be wider than the remainder of the internal passage 34, but slightly narrower than a diameter of the rounded socket 38 where the reservoir 36 meets the socket 38. The internal passage 34 permits transmission of a pressurized fluid from the coupling 32 to the socket 38.

Figure 3:
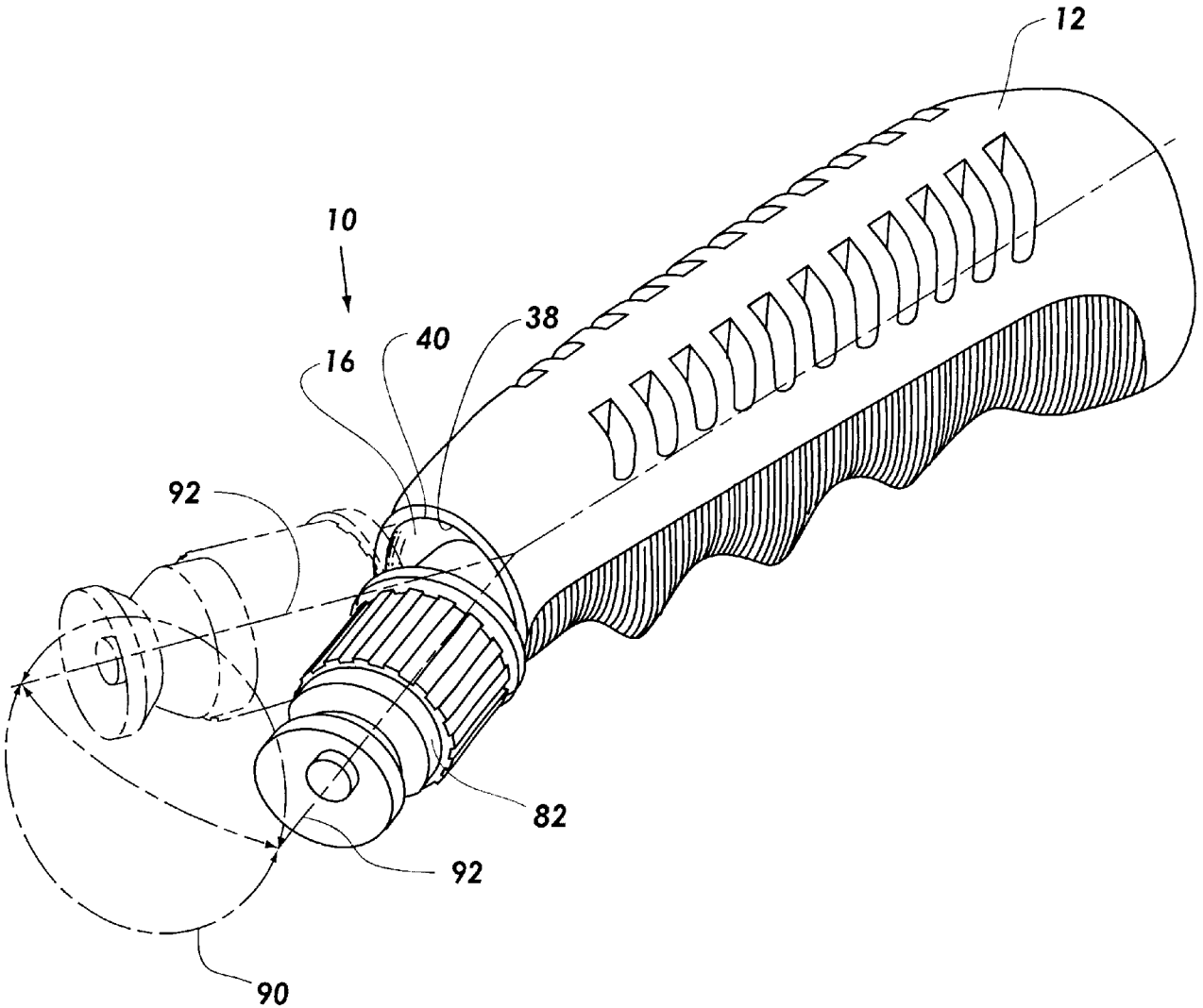
FIG. 3 is a perspective view of the first embodiment of the multi-directional spray nozzle illustrating a conical range of positions of a pivoting member of the nozzle.

The socket 38 is in fluid communication with the reservoir 36 of the internal passage 34. The socket 38 has a generally rounded shape. More specifically, in the embodiment shown in FIG. 1, the socket 38 has a generally spherical shape. The socket 38 also includes an exterior opening 40, which may have a generally circular shape. The circular shape of the exterior opening 40 is best seen in FIG. 3.

As stated above, the nozzle 10 also includes a stem 14 having a rounded end 16. The stem 14 is elongated and, excluding the rounded end 16, has a generally cylindrical shape. As illustrated in FIG. 1, the stem 14 optionally includes a first and a second cylindrical region 48, 50. The first cylindrical region 48 is more narrow than and concentrically situated relative to the second cylindrical region 50. The stem 14 may be formed from various durable substances, such as brass or various types of hard plastics.

In the embodiment illustrated in FIG. 1, the rounded end 16 has a generally spherical shape and is dimensioned to pivotally engage the socket 38. The interaction between the rounded end 16 and the socket 38 will be discussed in greater detail in connection with FIGS. 2–3.

Figure 2:
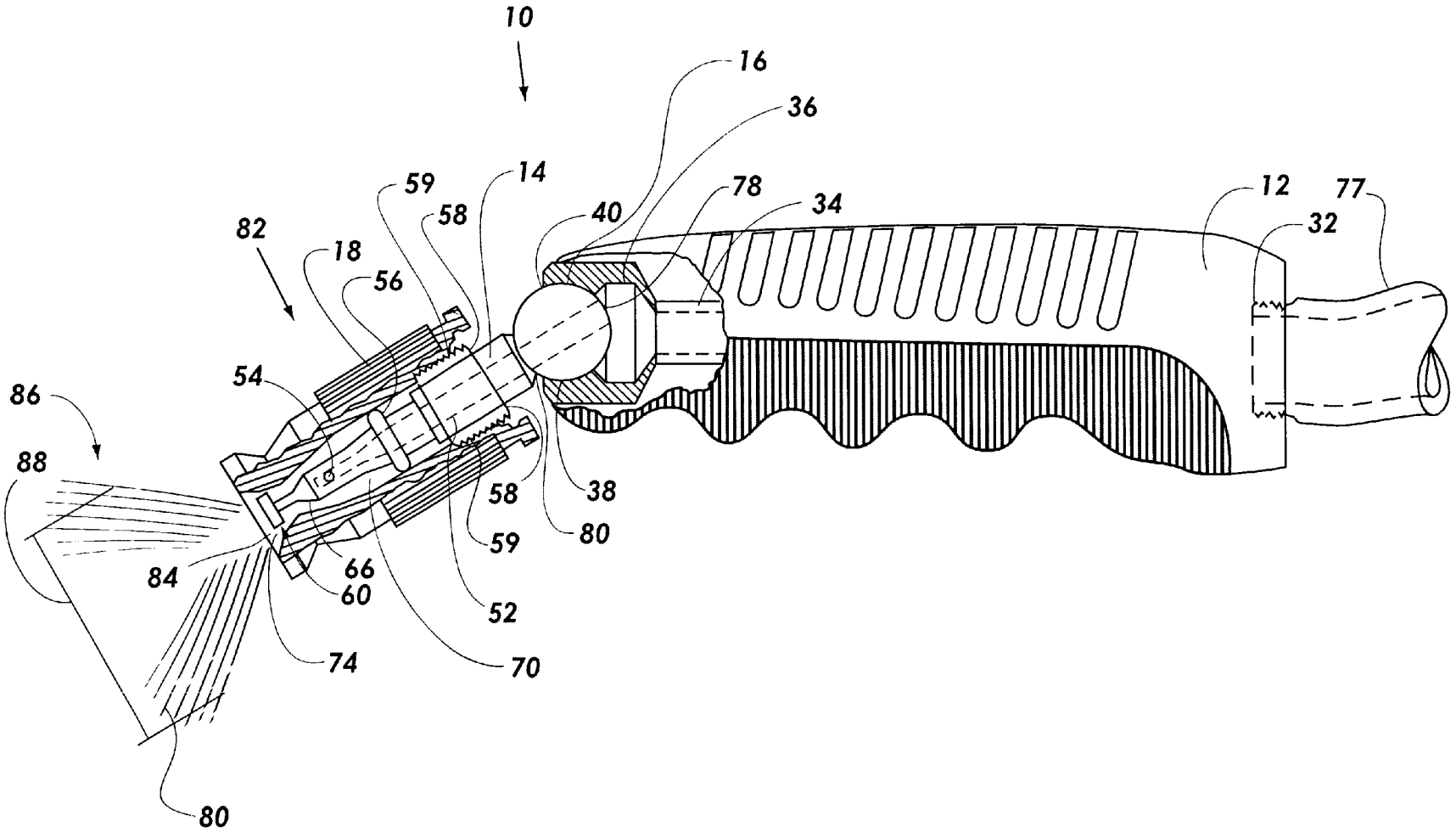
FIG. 2 is a partially cutaway view of the first embodiment of the multi-directional spray nozzle connected to a hose.

A longitudinal passage 52 passes through a portion of the stem 14 and rounded end 16. When the rounded end 16 is disposed within the socket 38, as illustrated in FIG. 2, the longitudinal passage 52 is in fluid communication with the internal passage 34 of the grip member 12. The longitudinal passage 52 is also in fluid communication with an outlet 54 through which a pressurized fluid exits the stem 14. The stem 14 includes one or more outlets 54 of various sizes, shapes, and positions on the stem 14. For instance, an array of outlets 54 may be positioned in a circular pattern around the stem 14.

A grommet 56 is disposed around the stem 14. The grommet 56 is circular to conform to the exterior surface of the stem 14. The grommet 56 is made from rubber or another material which can be used to create a seal between the stem 14 and the adjustment sleeve 18 when the adjustment sleeve 18 is positioned around the stem 14.

The stem 14 also includes outward threads 58. The outward threads 58 are shaped to mate with inward threads 59 of the sleeve 18, as will be discussed below.

The stem 14 also has a head 60. The head 60 optionally includes a broad tip 62, a narrow neck 64, and a broadening portion 66. The narrow neck 64 is positioned between the broad tip 62 and the broadening portion 66. The narrow neck 64 is more narrow than both the broad tip 62 and the broadening portion 66. The broadening portion 66 increases in width in a direction away from the narrow neck 64. At its widest point, the broadening portion 66 is wider than the broad tip 62. The head 60 has a generally rounded cross-sectional shape.

The nozzle 10 also includes an adjusting sleeve 18. The sleeve 18 has an inner cavity 70. The inner cavity 70 is generally sized to receive the stem 14. Inward threads 59 are formed within the inner cavity 70. The inward threads 59 are shaped to mate with the outward threads 58 of the stem 14. Accordingly, the adjusting sleeve 18 rotatably engages the stem 14. Also, when the stem 14 is positioned within the adjusting sleeve 18, the grommet 56 forms a seal between the stem 14 and the adjusting sleeve 18.

One end of the adjusting sleeve 18 is partially enclosed to define an exit orifice 74. The exit orifice 74 is shaped to receive the head 60 of the stem 14. More specifically, the broad tip 62 and narrow neck 64 of the head 60 is more narrow than the exit orifice 74 such that the broad tip 62 can pass through the exit orifice 74. The broadening portion 66, at its widest point, is wider than the exit orifice 74 such that at least a part of the broadening portion 66 cannot pass through the exit orifice 74.

The adjusting sleeve 18 optionally includes a corrugated exterior surface 76. The corrugated exterior surface 76 enables a user to easily grasp the adjusting sleeve 18, even when the sleeve 18 is wet. Accordingly, a user may conveniently rotate the sleeve 18 relative to the stem 14 when the stem 14 and sleeve 18 are in threaded engagement.

As illustrated, the adjusting sleeve 18 may be situated in close proximity to the grip member 12 such that the adjusting sleeve 18 may be rotated in a single-handed operation. For instance, a user may rotate the adjusting sleeve 18 with his thumb and forefinger while a portion of the user's hand grasps the grip member 12. Accordingly, a user may adjust the spray pattern 86 using a single hand.

With reference to FIG. 2, a partially cutaway view of the first embodiment of the multi-directional spray nozzle 10 connected to a hose 77 is illustrated. The hose 77 can be connected to the nozzle 10 using the water source coupling 32. The rounded end 16 of the stem 14 pivotally engages the socket 38 of the grip member 12 to form a ball-and-socket joint. The stem 14 and a portion of the rounded end 16 extend out of the socket 38 through the exterior opening 40. An open end 78 of the longitudinal passage 52 is positioned adjacent to the reservoir 36 of the internal passage 34. The internal passage 34 and the longitudinal passage 52 are in fluid communication.

The rounded end 16 of the stem 14 may be positioned in the socket 38 using various techniques. For instance, the socket 38 may be an integral piece with the rounded end 16 being "press-fit" into the socket 38. Alternatively, the socket 38 may be formed from multiple pieces that can be attached together when the rounded end 16 is positioned within the socket 38.

As will be explained in greater detail in connection with FIG. 3, a user can position the longitudinal passage 52 at various angles relative to the grip member 12. At each of these angles, the open end 78 of the longitudinal passage 52 maintains fluid communication with the internal passage 34. The width of the reservoir 36 provides a wide range of angles at which the open end 78 of the longitudinal passage 52 maintains fluid communication with the internal passage 34. Also, a shoulder 80 of the stem 14 may contact portions of the grip member 12 surrounding the socket 38, limiting angles at which the longitudinal passage 52 can be positioned relative to the grip member 12.

As shown in FIG. 2, the adjusting sleeve 18 rotatably engages the stem 14. More specifically, the outward threads 58 of the stem 14 are in threaded engagement with the inward threads 59 of the adjusting sleeve 18. A combination of the adjusting sleeve 18 and stem 14 pivots relative to the grip member 12 and, accordingly, can be referred to in generally as a pivoting member 82.

The head 60 of the stem 14 and the exit orifice 74 of the adjusting sleeve 18 form an exit port 84 through which a pressurized fluid exits the nozzle 10. Because the adjusting sleeve 18 and stem 14 are in threaded engagement, rotation of the adjusting sleeve 18 relative to the stem 14 changes a position of the head 60 relative to the exit orifice 74. Changing the position of the head 60 relative to the exit orifice 74 alters a spray pattern 86 of a pressurized fluid exiting the nozzle 10. For instance, moving the broadening portion 66 of the head 60 closer to the exit orifice 74 increases a width 88 of the spray pattern 86. Also, rotation of the adjusting sleeve 18 such that the broadening portion 66 of the head 60 is forced against the exit orifice 74 closes the exit port 84.

As will be understood by those skilled in the art, the stem 14 and adjustment sleeve 18 may be rotatably engaged using techniques other than threaded engagement. For instance, a circular outward slot (not shown) on the stem 14 may interface with one or more inward projections (not shown) of the adjustment sleeve 18. Rotation of the adjustment sleeve 18 may position an obstruction (not shown) on, for example, the outlet 54 or exit orifice 74 to close the nozzle 10. Those skilled in the art will recognize that control of the spray pattern 86 may be achieved using various mechanisms and/or techniques.

In addition, the grommet 56 of the stem 14 provides a substantially fluid-tight seal between the stem 14 and the adjusting sleeve 18. Accordingly, a pressurized fluid passes from the hose 77, through the internal passage 34 of the grip member 12 and then through the longitudinal passage 52 of the stem 14. As the pressurized fluid exits the outlet 54 of the stem 14, the fluid passes into and fills a portion of the inner cavity 70 bounded by the grommet 56. The pressurized fluid is then forced out of the inner cavity 70 through the exit port 84.

Referring to FIG. 3, a perspective view of the first embodiment of the multi-directional spray nozzle 10 illustrates a conical range of positions 90 of the pivoting member 82 of the nozzle 10. As stated above, in this first embodiment of the nozzle 10, the rounded end 16 has a spherical shape. Also, the exterior opening 40 of the socket 38 has a circular shape. As such, a longitudinal axis 92 of the pivoting member 82 can be positioned within a generally conical range of positions 90 relative to the grip member 12. The range of positions 90 of the pivoting member 82 makes the nozzle 10 easy to customize and tailor to a particular user's situation.

The pivoting member 82 is situated in close proximity to the grip member 12 such that the pivoting member 82 may be positioned relative to the grip member 12 in a single-handed operation. As such, a user may redirect the spray pattern 86 using a single hand.

A tight fit between the socket 38 and the rounded end 16 maintains a fluid-tight seal between the socket 38 and the rounded end 16. Additionally, once a user positions the pivoting member 82 at a particular angle relative to the grip member 12, the tight fit between the socket 38 and the rounded end 16 generally maintains the pivoting member 82 at this angle until it is changed by the user.

Figure 4:
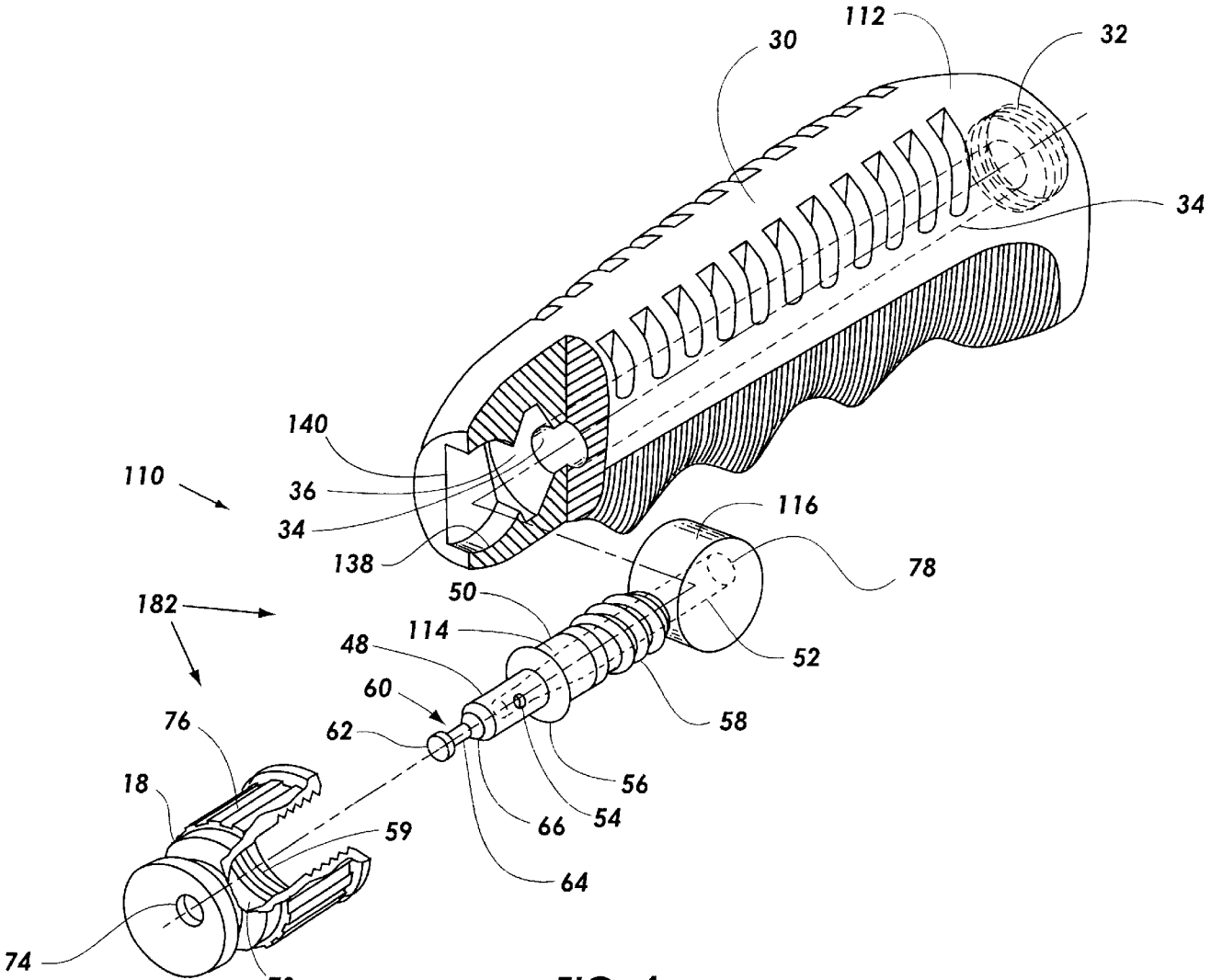
FIG. 4 is an exploded perspective view of a second embodiment of a multi-directional spray nozzle with a partially cutaway view of a grip member and an adjusting sleeve.

With reference to FIG. 4, an exploded perspective view of a second embodiment of a multi-directional spray nozzle 110 is shown. The second embodiment includes a grip member 112, a stem 114 having a rounded end 116, and an adjusting sleeve 18.

The grip member 112, as in the first embodiment, includes an insulated grip 30, a water source coupling 32, and an internal passage 34 having a reservoir 36. Once again, the insulated grip 30 is shaped to receive the human hand. The water source coupling 32 provides for connection of a hose 77 to the nozzle 110. The internal passage 34 permits transmission of a pressurized fluid to a socket 138 of the grip member 112.

However, the socket 138 of the second embodiment has a generally cylindrical shape instead of a spherical shape. In addition, the exterior opening 140 of the socket 138 may have a generally elongated shape instead of a circular shape. For example, the exterior opening 140 may be substantially rectangular in shape.

Like the stem 14 of the first embodiment, the stem 114 of the second embodiment includes a longitudinal passage 52 having an open end 78, an outlet 54, a grommet 56, outward threads 58, and a head 60 having a broad tip 62, a narrow neck 64, and a broadening portion 66. A pressurized fluid enters the longitudinal passage 52 through the open end 78 and exit the stem 114 through the outlet 54. The head 60 can control the emission of the pressurized fluid from the nozzle 110.

A rounded end 116 of the second embodiment, unlike the rounded end 16 of the first embodiment, has a generally cylindrical shape rather than a spherical shape. The rounded end 116 is dimensioned to pivotally engage the cylindrically shaped socket 138 of the grip member 112.

In the second embodiment, the adjusting sleeve 18 is configured in the same manner as the adjusting sleeve 18 of the first embodiment. More specifically, the adjusting sleeve 18 includes an inner cavity 70, inward threads 59, an exit orifice 74, and an exterior corrugated surface 76. The inner cavity 70 is shaped to receive the stem 114. The inward threads 59 mate with the outward threads 58 of the stem 114 in threaded engagement. The exit orifice 74 is sized to receive the head 60 of the stem 114.

Figure 5:
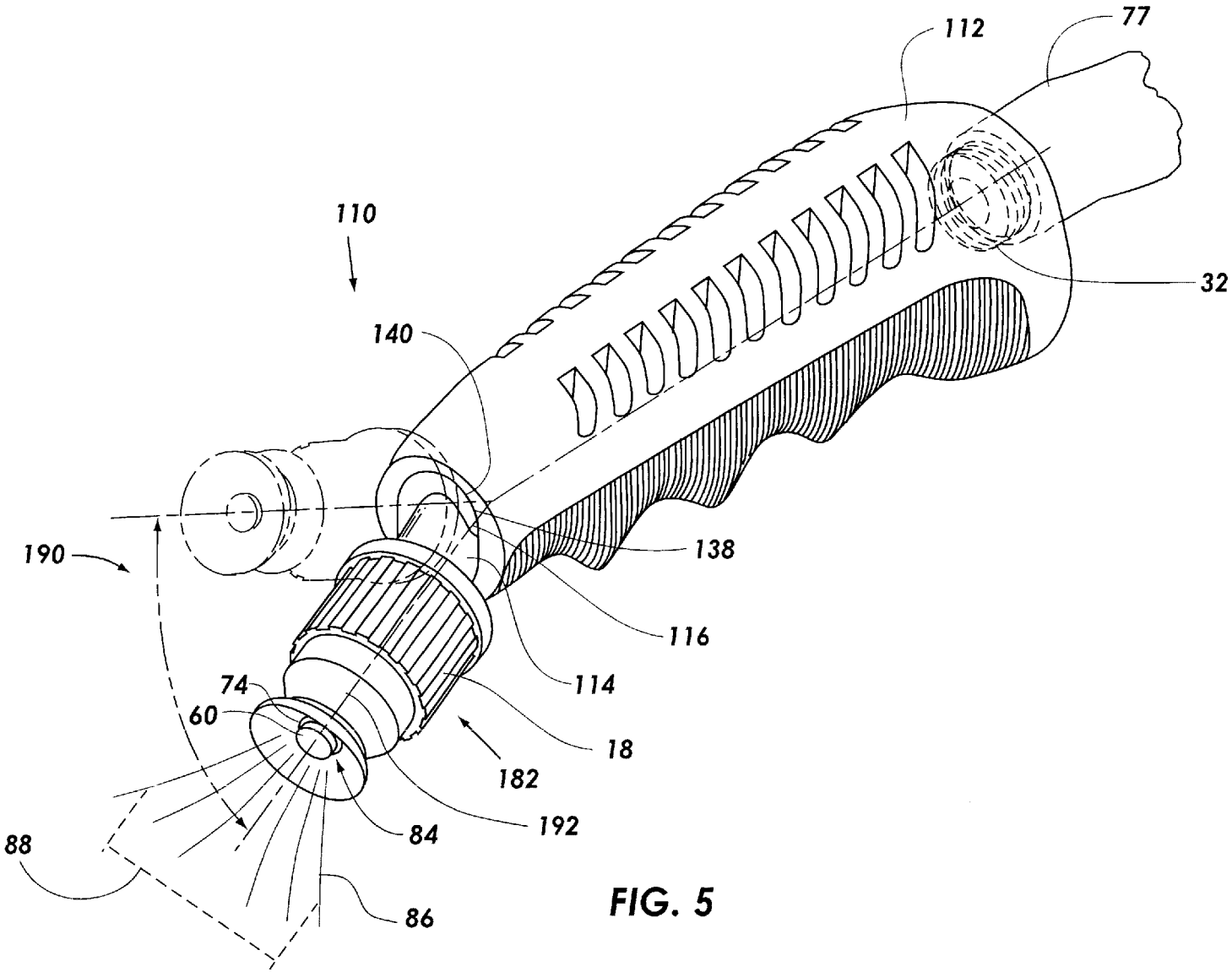
FIG. 5 is a perspective view of the second embodiment of the multi-directional spray nozzle illustrating a linear range of positions of a pivoting member of the nozzle.

FIG. 5 shows a perspective view of the second embodiment of the multi-directional spray nozzle 110 connected to a hose 77. The hose 77 can be connected to the nozzle 110 using the water source coupling 32. As in the first embodiment, in the second embodiment, the adjusting sleeve 18 rotatably engages the stem 114 to form a pivoting member 182. A combination of the head 60 and exit orifice 74 form an exit port 84 through which pressurized fluid exits the nozzle 110 to form a spray pattern 86. A width 88 of the spray pattern 86 can be altered by changing a position of the head 60 relative to the exit orifice 74.

As shown in FIG. 5, the rounded end 116 of the pivoting member 182 pivotally engages the socket 138 to form a hinged joint. As stated above, the rounded end 116 of the second embodiment has a generally cylindrical shape and is formed to mate with the socket 138, which also has a generally cylindrical shape. Again, the exterior opening 140 may have an elongated shape. The stem 114 and a portion of the rounded end 116 extend out of the socket 138 through the exterior opening 140. Accordingly, the pivoting member 182 can be positioned in a linear range of positions 190 relative to the grip member 112. More specifically, a longitudinal axis 192 of the pivoting member 182 can be positioned in the linear range of positions 190 relative to the grip member 112.

As in the first embodiment, the adjusting sleeve 18 may be situated in close proximity to the grip member 112 such that the adjusting sleeve 18 may be rotated in a single-handed operation. Similarly, the pivoting member 182 is situated in close proximity to the grip member 112 such that the pivoting member 182 may be positioned relative to the grip member 112 in a single-handed operation.

As will be understood by those skilled in the art, the multi-directional spray nozzle may be embodied in a number of different ways. For instance, the multi-directional spray nozzle could be generally configured in the shape of a pistol. In such an embodiment, a longitudinal axis of the grip member may be generally disposed at an angle that is within 10° of perpendicular relative to a longitudinal axis of the pivotal member. Of course, the longitudinal axis of the grip member may be disposed at other less severe angles relative to the longitudinal axis of the grip member to form, for example, a generally banana-shaped nozzle. As with other embodiments discussed herein, the pivotal member could be positioned in a range of positions relative to the grip member.

The multi-directional spray nozzle provides substantial advantages over conventional nozzles. The pivoting member of the multi-directional spray nozzle may be positioned at a number of different angles relative to the grip member. Accordingly, the spray pattern of the multi-directional spray nozzle may be positioned in a desired direction, while the grip member may be held by the user in a comfortable position.

What is claimed is:

1. A multi-directional spray nozzle connectable to receive and spray fluid from a garden hose, the multi-directional spray nozzle comprising:

a grip member having a fluid source coupling shaped to receive the garden hose, an internal passage disposed to receive fluid from the garden hose when the garden hose is connected to the fluid source coupling, and a socket in fluid communication with the internal passage; and a pivoting member having an exit port, a rounded end pivotally engaging the socket, a longitudinal passage in fluid communication with the internal passage and the exit port, a stem extending from the rounded end, the longitudinal passage passing through the stem and rounded end, and an adjusting sleeve rotatably engaging the stem in threaded engagement therewith to permit alteration of a spray pattern of a fluid emitted from the exit port.

2. The multi-directional spray nozzle of claim 1, wherein the rounded end has a generally spherical shape, whereby the rounded end and socket form a ball-and-socket joint.

3. The multi-directional spray nozzle of claim 1, wherein the pivoting member has a longitudinal axis and is positionable in a plurality of positions relative to the grip member such that the longitudinal axis falls within a generally conical range of positions.

4. The multi-directional spray nozzle of claim 1, wherein the rounded end has a generally cylindrical shape, whereby the rounded end and socket form a hinged joint.

5. The multi-directional spray nozzle of claim 1, wherein the pivoting member has a longitudinal axis and is positionable in a plurality of positions relative to the grip member such that the longitudinal axis falls within a generally linear range of positions.

6. The multi-directional spray nozzle of claim 1, wherein the adjusting sleeve further comprises an exit orifice, and wherein the stem further comprises a head shaped to be positioned within the exit orifice, the exit orifice and head forming the exit port.

7. The multi-directional spray nozzle of claim 6, wherein rotation of the adjusting sleeve relative to the stem varies a position of the head relative to the exit orifice to alter a spray pattern of a pressurized fluid emitted from the exit port.

8. The multi-directional spray nozzle of claim 1, wherein the internal passage further comprises a reservoir positioned adjacent to the socket.

9. A multi-directional spray nozzle connectable to receive and spray fluid from a garden hose, the multi-directional spray nozzle comprising:

a grip member having a fluid source coupling shaped to receive the garden hose, an internal passage disposed to receive fluid from the garden hose when the garden hose is connected to the fluid source coupling, and a socket in fluid communication with the internal passage; and a pivoting member having an exit port, a generally cylindrical end pivotally engaging the socket to form a hinged joint, and a longitudinal passage in fluid communication with the internal passage and the exit port.

10. The multi-directional spray nozzle of claim 9, wherein the pivoting member has a longitudinal axis and is positionable in a plurality of positions relative to the grip member such that the longitudinal axis falls within a generally linear range of positions.

11. The multi-directional spray nozzle of claim 9, wherein the pivoting member further comprises a stem extending from the generally cylindrical end, the longitudinal passage passing through the stem and spherical end.

12. The multi-directional spray nozzle of claim 11, wherein the pivoting member further comprises an adjusting sleeve rotatably engaging the stem.

13. The multi-directional spray nozzle of claim 12, wherein the adjusting sleeve rotates about the stem in threaded engagement.

14. The multi-directional spray nozzle of claim 13, wherein the adjusting sleeve further comprises an exit orifice, and wherein the stem further comprises a head shaped to be positioned within the exit orifice, the exit orifice and head forming the exit port.

15. The multi-directional spray nozzle of claim 14, wherein rotation of the adjusting sleeve relative to the stem varies a position of the head relative to the exit orifice to alter a spray pattern of a pressurized fluid emitted from the exit port.

16. A multi-directional spray nozzle comprising:

a grip member having an internal passage, an insulated grip, and a socket in fluid communication with the internal passage;

a rounded end pivotally engaging the socket;

a stem extending from the rounded end, the stem comprising a head; and an adjusting sleeve rotatably engaging the stem in threaded engagement therewith, wherein the rounded end, stem, and adjusting sleeve define an exit port and a longitudinal passage in fluid communication with the internal passage and the exit port, wherein rotation of the adjusting sleeve relative to the stem varies a position of the head relative to the adjusting sleeve to alter a spray pattern of a fluid emitted from the exit port.

17. The multi-directional spray nozzle of claim 16, wherein the rounded end has a generally spherical shape, whereby the rounded end and socket form a ball-and-socket joint.

18. The multi-directional spray nozzle of claim 16, wherein the pivoting member has a longitudinal axis and is positionable in a plurality of positions relative to the grip member such that the longitudinal axis falls within a generally conical range of positions.

19. The multi-directional spray nozzle of claim 16, wherein the rounded end has generally cylindrical shape, whereby the rounded end and socket form a hinged joint.

20. The multi-directional spray nozzle of claim 16, wherein the pivoting member has a longitudinal axis and is positionable in a plurality of positions relative to the grip member such that the longitudinal axis falls within a generally linear range of positions.

21. The multi-directional spray nozzle of claim 16, wherein the adjusting sleeve further comprises an exit orifice, and wherein head is shaped to be positioned within the exit orifice, the exit orifice and head forming the exit port.

22. A method of directing a spray pattern of a spray nozzle in a direction most comfortable to a user, the method comprising: Connecting a fluid source coupling to a garden hose;

grasping a grip member having an internal passage disposed to receive fluid from the garden hose, and a socket in fluid communication with the internal passage;

positioning a pivoting member relative to the grip member such that a longitudinal axis of the pivoting member is positioned at a desired angle relative to the grip member, the pivoting member having an exit port, a generally cylindrical end pivotally engaging the socket, and a longitudinal passage in fluid communication with the internal passage and the exit port; and emitting a fluid from the exit port.

23. The method of claim 22, wherein positioning comprises placing the pivoting member in one of a plurality of positions relative to the grip member such that the longitudinal axis falls within a generally conical range of positions.

24. The method of claim 22, wherein positioning comprises placing the pivoting member in one of a plurality of positions relative to the grip member such that the longitudinal axis falls within a generally linear range of positions.

25. The method of claim 22, further comprising altering the spray pattern by rotating an adjusting sleeve having an exit orifice relative to a stem extending from the rounded end, the stem having a head shaped to be positioned with the exit orifice.

26. The method of claim 25, wherein a user rotates the adjusting sleeve and grasps the grip member in a single-handed operation.

27. The method of claim 22, wherein a user positions the pivoting member and grasps the grip member in a single-handed operation.

* * * * *